US006570500B1

(12) United States Patent
Pieper

(10) Patent No.: US 6,570,500 B1
(45) Date of Patent: May 27, 2003

(54) INFRA-SOUND SURVEILLANCE SYSTEM

(75) Inventor: Norbert Pieper, Olfen (DE)

(73) Assignee: Nokia Corporation, Espoo (FI)

( * ) Notice: Subject to any disclaimer, the term of this patent is extended or adjusted under 35 U.S.C. 154(b) by 0 days.

(21) Appl. No.: 09/986,604

(22) Filed: Nov. 9, 2001

(51) Int. Cl.[7] ..... G08B 13/00

(52) U.S. Cl. ..... 340/541; 340/544; 340/550; 340/566; 73/587; 73/594; 381/15; 381/16

(58) Field of Search ..... 340/541, 544, 340/550, 566; 73/587, 594; 381/15, 16

(56) References Cited

U.S. PATENT DOCUMENTS 3,908,090 A * 9/1975 Kahn ..... 381/16
4,018,994 A * 4/1977 Kahn ..... 381/15
4,159,398 A * 6/1979 Hilbert et al. ..... 381/16
4,301,330 A * 11/1981 Trump ..... 381/55
4,470,020 A * 9/1984 Mohr ..... 330/304
4,489,431 A * 12/1984 Ecklund ..... 381/15
4,503,397 A * 3/1985 Schultz ..... 328/138
4,629,834 A * 12/1986 Waggoner et al. ..... 381/68.2
4,800,293 A * 1/1989 Miller ..... 307/117
5,793,286 A * 8/1998 Greene ..... 340/522

* cited by examiner

*Primary Examiner*—Daryl Pope
(74) *Attorney, Agent, or Firm*—Antonelli, Terry, Stout & Kraus, LLP

(57) ABSTRACT

The invention is a method for monitoring an environment by evaluating an infrasonic signal obtained from said environment. The method includes averaging said infrasonic signal ($V_{infra}$) to provide an averaged infrasonic signal ($V_{av}$), mapping said averaged infrasonic signal ($V_{av}$) according to a function to provide an infrasonic noise signal ($V_{noise}$); averaging said infrasonic noise signal ($V_{noise}$) to provide an averaged infrasonic noise signal ($V_{av\ noise}$); offsetting said averaged infrasonic noise signal ($V_{av\ noise}$) with an offset value to provide an infrasonic level signal ($V_{limit}$); comparing said infrasonic level signal ($V_{limit}$) with said averaged infrasonic signal ($V_{av}$); and generating a trigger signal (30) if said averaged infrasonic signal ($V_{av}$) is greater than said infrasonic level signal ($V_{limit}$).

29 Claims, 6 Drawing Sheets

INFRA-SOUND SURVEILLANCE SYSTEM

BACKGROUND OF THE INVENTION

1. Field of the Invention

The present invention relates to a method, a module, a device, a module and a system for detecting an environment noise by evaluating an infrasonic signal. Particularly, the method according to the present invention provides a continuous level adjustment algorithm to adapt the detection level to a noise background for evaluating the infrasonic signal, for example to monitor a certain ambiance or environment.

2. Description of the Prior Art

Sound frequencies in a frequency range of about 0.1 Hz up to 20 Hz are normally designated as infra-sound. Infra-sound or an infrasonic pulse is generated by small changes of the air pressure, respectively. Such small changes of the air pressure may be generated by opening or closing of a door or a window but even by persons moving though a room. Due to the object surfaces moving through the air small changes of the air pressure are released such that infrasonic pulses are emitted by the respective moving object. These infrasonic pluses or infra-sound may by detected in a radius of up to 50 m away from the emerging object. But the radius of detection is further dependent on background noise and the space within which the infra-sound is propagating.

To detect infra-sound special microphones are used. These microphones are adapted to detect low frequency sound since low frequency sound is additionally often of low amplitude or low power, respectively. Nevertheless, microphones able to detect infra-sound (about 0.1 Hz to 20 Hz) and speech (about 200 Hz to 15 kHz) are available at reliable detection sensitivity.

A couple of detector systems and devices are in use to protect environments, rooms, homes, buildings and cars from being accessed in an unauthorized way. The mainly used detectors are ultrasonic motion detectors, infra-red detectors, light barriers and the like. These detectors may be combined with an alarm system in order to secure a respective object. Also infra-sound detectors are able to monitor a space signalling an opening of a door or a window or even a motion within the monitored space. Such infra-sound detectors are well known and used in motor vehicles to trigger an alarm system for example to prevent burglary of the motor vehicles.

Applications are known where separate infra-sound detecting devices are connected to a mobile phone, like described in WO 99/53456. These infra-sound detecting devices are used to trigger or rise any kind of alarm or monitoring action.

Normally, special infra-sound detecting microphones are used for detecting infra-sound events. These infra-sound microphones are expensive and require the implementation of a separate infrasound microphone. The usage of microphones detecting sound in a wide frequency range covering infra-sound frequencies and voice/speech frequencies enables extending the devices processing voice/speech audio signals to an alarm system by operating these devices to evaluate infrasonic signals detected by the microphones.

Usually, infra-sound detection systems, especially used in combination with alarm systems, employ fixed detection levels. The detection level defines an infra-sound level, normally an infra-sound amplitude level, at which a detected infra-sound event is interpreted as event to be signalized for example by an alarm of the alarm system. The fixed detection level is often adjustable to the environmental noise background but the environmental noise background can change due to outer effects. For example, while monitoring the infra-sound within a motor vehicle, the monitored infra-sound background level is dependent upon the place where the motor vehicle is parked. Near a heavily used road the infra-sound background level may be higher than within a residential area. That means, that in case of a low detection level a lot of false alarms are triggered or in case of a high detection level a careful opening of a door might be unnoticed. Both cases are undesired.

SUMMARY OF THE INVENTION

The invention is a method for monitoring an environment by evaluating an infrasonic signal taking a sound of said environment.

The invention is a module of a surveillance system for monitoring the environment by evaluating an infrasonic signal.

The invention is a device of a surveillance system for monitoring by evaluating an infrasonic signal The invention is a system of a surveillance system for monitoring by evaluating an infrasonic signal.

Therefore, a continuous level adjustment algorithm provides the possibility to pre-determine a detection level which is continuously adapted to the background level. The number of false alarm of an alarm system which uses this algorithm to evaluate measured infra-sound can be reduced while the overall sensitivity of the infra-sound event detection is quite low arid hence reliable.

According to a first aspect of the invention a method of a surveillance system for monitoring by evaluating an infrasonic signal is provided. An infrasonic signal is averaged to yield an averaged infrasonic signal. The averaged infrasonic signal is mapped according to a function to yield an infrasonic noise signal. This infrasonic noise signal is averaged to yield an averaged infrasonic noise signal. By offsetting the averaged infrasonic noise signal with an offset value an infrasonic level signal is provided. This infrasonic level signal is compared with the averaged infrasonic signal. According to the comparison if the averaged infrasonic signal is greater than the infrasonic level signal a trigger signal is generated.

The infrasonic signal may be provided by filtering. The filtering may be employed on signals comprising infrasonic signals and non-infrasonic signals, i.e. signals of non-infrasonic frequency. Hence, the characteristic of the filtering may be limited to an infrasonic frequency range. The filtering may be a band-pass filter employed to extract an infrasonic signal. The band-pass filter characteristic may be limited to an infrasonic frequency range. A low-pass filter may also be employed for extracting the infrasonic signal. Accordingly, the low-pass filter characteristic may be limited to an infrasonic frequency range.

The averaged infrasonic signal may be a root mean square infrasonic signal. But also further averaging methods may be employed on the infrasonic signal to yield the averaged infrasonic signal.

The mapping of the averaged infrasonic signal may also comprise an additional rating of the function result with the averaged infrasonic noise signal. The function for mapping may be a non-linear function. This function may be used for weighting an additional rating signal, especially the averaged infrasonic noise signal. The function argument may by the result of an arbitrary combination of the averaged infrasonic signal arid the averaged infrasonic noise signal. Particularly, the argument may be the result of the division of the averaged infrasonic signal and the averaged infrasonic noise signal. Moreover, the function may map the result the division of the averaged infrasonic signal and the averaged infrasonic noise signal to provide a function result and this function result may be multiplied with the averaged infrasonic noise signal to provide the infrasonic noise signal.

The offset value may be an absolute offset value, increasing the averaged infrasonic noise signal by a constant absolute value. The offset value may be a relative offset value. The increasing offset of the averaged infrasonic noise signal is determined relatively to the averaged infrasonic noise signal. Further, the offset value may be multiplied with the averaged infrasonic noise signal to provide the infrasonic level signal. Particularly, the offset value may be defined by a signal-to-noise ratio (SNR). Moreover, the offset value may be adjustable to adapt the evaluation method to different operating conditions.

According to another aspect of the invention a software tool of a surveillance system for monitoring by evaluating an infrasonic signal is provided. The software tool comprises program potions for carrying out the operations of the aforementioned methods of a surveillance system for monitoring by evaluating an infrasonic signal when the software tool is implemented in a computer program and/or executed on a computer, a processing device or a digital signal processing device.

According to another aspect of the invention a computer program product is provided which comprises program code portions stored on a computer readable medium for carrying out the aforementioned methods of a surveillance system for monitoring by evaluating an infrasonic signal when the program product is executed on a computer, a processing device or a digital signal processing device.

According to another aspect of the invention a module of a surveillance system for monitoring by evaluating an infrasonic signal is provided. The module comprises a first averaging component for averaging the signal to provide an averaged infrasonic signal, a mapping component for mapping the averaged infrasonic signal according to a function to provide an infrasonic noise signal, a second averaging component for averaging the infrasonic noise signal to provide an averaged infrasonic noise signal, an offsetting component for offsetting the averaged infrasonic noise signal with an offset value to provide an infrasonic level signal, a comparing component comparing the infrasonic level signal with the averaged infrasonic signal and a generating component generating a trigger signal if the averaged infrasonic signal is greater than the infrasonic level signal.

The module may also comprise a filter component for filtering the infrasonic signal. The filter component may be employed on signals comprising infrasonic signals and non-infrasonic signals, i.e. signals of non-infrasonic frequency. For filtering the infrasonic signal the filter component characteristic may be limited to an infrasonic frequency range. It may be possible to employ a band-pass filter or a low-pass filter on the infrasonic signal.

The averaging component may. be a root mean square averaging component to provide a root mean square infrasonic signal as averaged infrasonic signal.

The mapping of the averaged infrasonic signal may also comprise an additional rating of the function result with the averaged infrasonic noise signal. Therefore, the module may also comprise a rating component for rating the function with the averaged infrasonic noise signal. The function for mapping may be a non-linear function. This function may be used for weighting an additional rating signal, especially the averaged infrasonic noise signal. The function argument may by the result of an arbitrary combination of the averaged infrasonic signal and the averaged infrasonic noise signal. Particularly, the argument may be the result of the division of the averaged infrasonic signal and the averaged infrasonic noise signal. Therefore, the module may comprise a dividing component for the averaged infrasonic signal and the averaged infrasonic noise signal. Moreover, the function may map the result the division of the averaged infrasonic signal and the averaged infrasonic noise signal to provide a function result and this function result may be multiplied with the averaged infrasonic noise signal to provide the infrasonic noise signal.

The offset value may be an absolute offset value, increasing the averaged infrasonic noise signal by a constant absolute value. The offset value may be a relative offset value. The increasing offset of the averaged infrasonic noise signal is determined relatively to the averaged infrasonic noise signal. Further, the offset value may be offset by multiplying with the averaged infrasonic noise signal to provide the infrasonic level signal. Particularly, the offset value may be defined by a signal-to-noise ratio (SNR). Moreover, the offset value may be adjustable to adapt the evaluation method to different operating conditions.

According to another aspect of the invention a device of a surveillance system for monitoring by evaluating an infrasonic signal is provided. The device comprises a detector to detect sound waves, a processing unit and components responsive to a trigger signal. The detector is adapted to a sound wave frequency range including an infrasonic frequency range. The processing unit executes the operation of the aforementioned method of a surveillance system for monitoring by evaluating an infrasonic signal and the infrasonic signal is provided by the detector. The trigger signal is generated according to the aforementioned method and initiates operations and functions of the device. The detector signals may have to be filtered to extract infrasonic signals out of the detector signals.

The detector for detecting infrasonic signals may be a microphone. The microphone may be adapted to an infrasonic frequency range. Further, the microphone may be adapted to an infrasonic frequency range and a frequency range of audio signals occurring in voice or speech.

The device may be a mobile phone. The mobile phone may be a mobile phone built-in a motor vehicle. Mobile phones include digital signal processing units to operate on voice signals of the user. These digital processing units may also operate the evaluation of the infrasonic signals. Therefore, it may be necessary that each mobile phones provide microphones which are able to detect both infrasonic signals and voice/speech signals.

The device may be a voice/speech controlled device. Device functions of such devices may be controlled by spoken commands. Therefore, the devices may each comprise a voice signal processing unit. This voice signal processing unit may also operate the evaluation of the infrasonic signals. Therefore, it may be necessary that the devices include microphones which are able to detect both infrasonic signals and voice/speech signals.

According to another aspect of the invention a system of a surveillance system for monitoring by evaluating an infrasonic signal is provided. The system comprises a module according to the aforementioned module of a surveillance system for monitoring by evaluating an infrasonic signal and a device processing voice/speech signals and infrasonic signals. This device comprises a detector to detect sound waves and components responsive to a trigger signal. The detector is adapted to a sound wave frequency range including an infrasonic frequency range. The trigger signal is provided by the module. The detector signals may have to be filtered to extract infrasonic signals out of the detector signals.

The detector for detecting infrasonic signals may be a microphone. The microphone may be adapted to an infrasonic frequency range. Further, the microphone may be adapted to an infrasonic frequency range and a frequency range of audio signals occurring in voice or speech sound signals.

The device may be a voice/speech controlled device. Device functions of such devices may be controlled by spoken commands. Therefore, the devices may each comprise a voice signal processing unit. This voice signal processing unit may also operate the evaluation of the infrasonic signals. Therefore, it may be necessary that the devices include microphones which are able to detect both infrasonic signals and voice/speech signals.

BRIEF DESCRIPTION OF THE DRAWINGS

The invention will now be described in more detail with reference made to the accompanying drawings, in which.

Identical parts shown in the drawings are referred to by the same reference numerals.

DESCRIPTION OF THE PREFERRED EMBODIMENTS

The evaluation process of the infrasonic signals provides the possibility to extract infrasonic signals out of the noise background or environmental noise. Since the infrasonic signals may be measured signals, background noise is always present within the measured signals. For example, especially in case of the utilization of an infrasonic detector for monitoring a certain space, like a room of a spacious interior of a motor vehicle or a building, substantial infrasonic signals are detected. The extraction of conspicuous infrasonic signals provides the possibility to monitor effectively a spacious interior which means that the number of false event detections is as small as possible and only reasonable events are reported.

The evaluation process is based on a suitable algorithm for extracting infrasonic signals. The evaluation process distinguishes itself by a continuous adaptation of a noise level determined for the infrasonic signal. This adaptation enables extraction of infrasonic signals even if the noise background is changing in time.

An additional provided offset value may define and be provided to the continuous level adjustment. The continuous level adjustment determines an averaged infrasonic noise level representing an averaged value of the background noise which is included in the infrasonic signal. A threshold value may be determined based on the offset value and the averaged infrasonic noise signal. The threshold level may be used for evaluating an infrasonic signal by comparing, i.e. infrasonic signals greater than the threshold value, extracted infrasonic signals of relevant values or strength by the evaluation process, respectively, which enables generation of a trigger in combination with this extraction process.

Figure 1A:
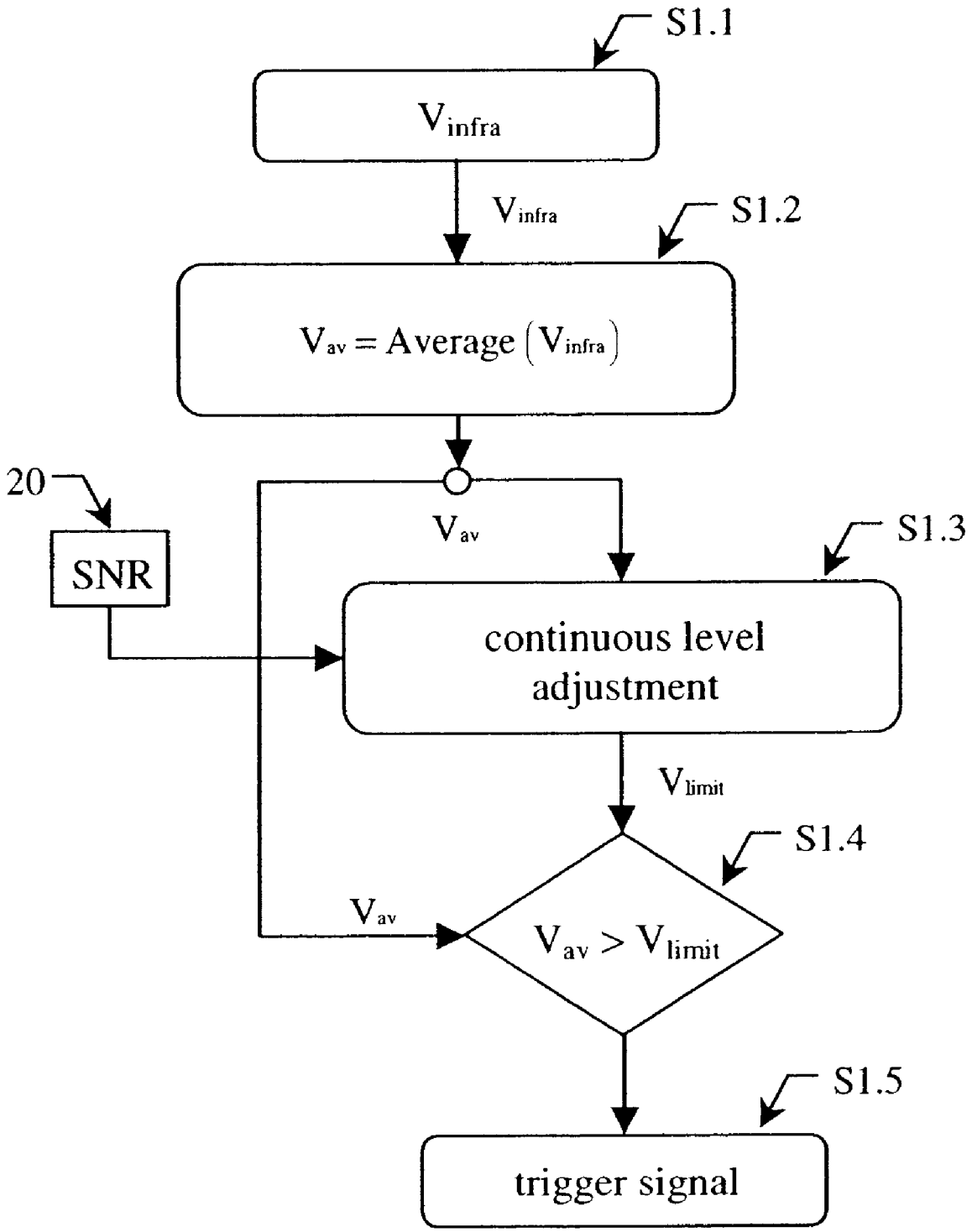
FIG. 1*a* shows a flow diagram of the operations for evaluating an infrasonic signal according to an embodiment of the invention.

FIG. 1*a* shows a flow diagram of the operations for evaluating an infrasonic signal according to an embodiment of the invention.

In an operation S1.1 an infrasonic signal $V_{infra}$ is provided. The infrasonic signal $V_{infra}$ may be a signal of an infra-sound detector. The infra-sound detector may be a microphone adapted to frequencies out of the infrasonic frequency range.

It may also be possible to obtain the infrasonic signal from a microphone adapted to frequencies in the infrasonic frequency range and audio frequencies. Most standard microphones adapted to audio frequencies and used for detecting audio signals have the possibility to detect infrasonic signals. The sensitivity of these microphones in the frequency range of infra-sound may be lower since these microphones are not optimized for detecting infra-sound but may even enable obtaining and evaluation of the infrasonic signals. It may be necessary to amplify the signals using suitable amplifier.

Further, it may be necessary to filter the infrasonic signals. Particularly in the case of using microphones adapted to a wide frequency range covering non-infrasonic frequencies an adapted filtering may have to be employed. Due to the kind of detector used for obtaining the infrasonic signals, a band-pass filter or a low-pass filter may be employed on the signals of the detector to obtain suitable infrasonic signals which can be evaluated according to an embodiment of the present invention. The characteristic of the filter may have to be adapted to the infrasonic frequency range or a part thereof.

In an operation S1.2 the infrasonic signal $V_{infra}$ may be averaged. The averaging may be any kind of averaging method. Further, a root mean square averaging may be possible. The averaging procedure results in an averaged infrasonic signal $V_{av}$.

Figure 1B:
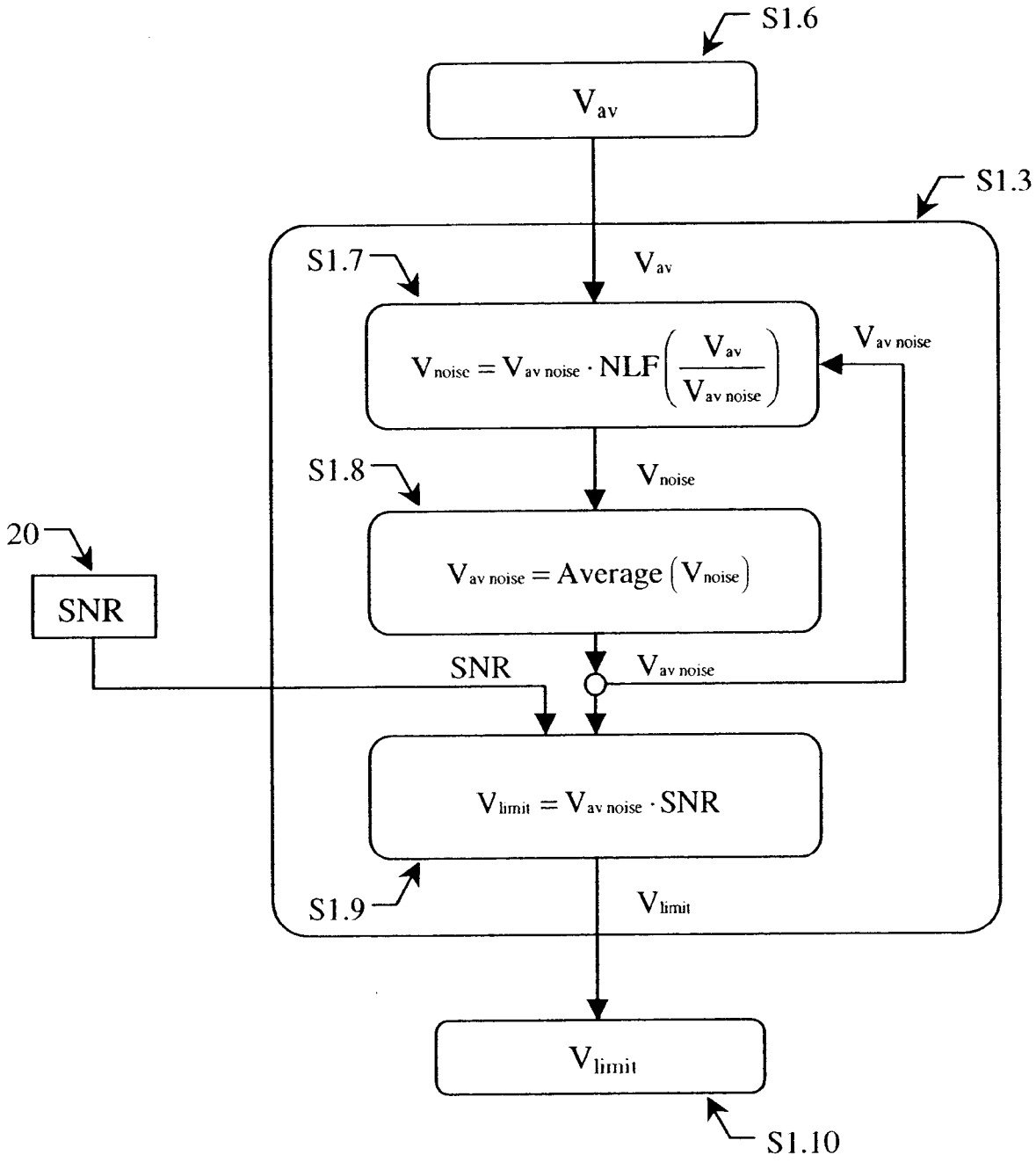
FIG. 1*b* shows a flow diagram of the continuous level adjustment algorithm according to FIG. 1*a,*

In an operation S1.3 an infrasonic level signal $V_{limit}$ is obtained from the averaged infrasonic signal $V_{av}$. The averaged infrasonic signal $V_{av}$ is obtained according to the continuous level adjustment (FIG. 1*b*). The continuous level adjustment provides a method to obtain an adapted noise level of a noise background of the infrasonic signal, which means that the adapted noise level is always adapted to the noise background even if the noise background is changing on a certain time scale. This adapted noise level is rated with an additional offset value which is provided to the continuous level adjustment. The adapted noise level may be rated with this additionally provided offset value to provide the infrasonic level signal.

The adapted noise level may represent a kind of mean noise background level with respect to a certain time scale. The rating of the adapted noise level with the offset value may be understood as increasing the adapted level by an offset value to obtain the infrasonic level signal $V_{limit}$. Thus the infrasonic level signal $V_{limit}$ defines a level signal which extends in time parallel to a noise background adapted level offset by an additional offset value.

The additional offset value is adjustable to define the sensitivity of the evaluation of the infrasonic signal. The adjustability provides the possibility to select an offset value according to the application. Referring again to the above mentioned example, in the case of monitoring a spacious interior of a motor vehicle, the background noise is more intensive and varies more on a short and long time scale as in the case of monitoring a spacious interior of a building. A noise background varying on a long time scale is covered by the above described continuous level adjustment. A noise background varying on a short time scale may be covered by an adjusted offset value.

The offset value may be an absolute offset value.

The offset value may define a relative offset value, i.e. the adapted noise level is offset by an offset value which is relative to the adapted noise level according to the offset value to provide the infrasonic noise signal $V_{limit}$. Further, that means that the higher the noise background the higher the offset value, whereas the offset value is small in the case of a small noise background.

It may be possible to provide a signal-to-noise ratio (SNR) 20 as the offset value to the continuous level adjustment. A SNR 20 is a relative value, i.e. the SNR 20 may be a factor with which the adapted noise level is rated or multiplied, respectively. A signal-to-noise ratio is a value known to those skilled in the art for defining usually a minimal signal level with respect to the noise background at which signal may be properly distinguished and evaluation of signals may be meaningful.

In an operation S1.4, the averaged infrasonic signal $V_{av}$ and the infrasonic level signal $V_{limit}$ are compared. If the averaged infrasonic signal $V_{av}$ is greater than the infrasonic level signal $V_{limit}$, a trigger signal may be initiated, It may also be possible to initiate a trigger signal if the averaged infrasonic signal $V_{av}$ is greater than or equal to the infrasonic level signal $V_{limit}$.

It may be possible to provide a pre-defined trigger signal in order to control further operations, devices, units or functions which may be operated in the case of a trigger event. Further it may also be possible to provide the averaged infrasonic signal $V_{av}$ itself as trigger signal which may be processed by further operations, devices, units or functions.

The continuous level adjustment algorithm is used to determine a threshold level, namely infrasonic level signal $V_{limit}$ which is described in more detail. The continuous level adjustment may allow determination of an averaged infrasonic noise signal which corresponds to the background noise or environmental noise of the infrasonic signal, respectively.

The origin of the noise background may be reduced to different noise sources. One of the sources may be infrasonic background signals detected and determined by the infrasonic detector. These signals may be based on physical processes in the detection space of the infrasonic detector. Moreover also infrasonic signals which may be traced back to dedicated events, but which may not be desired to be detected and evaluated, may be also termed as background noise. Further, the infrasonic detector may generate itself infrasonic signal due to the detection method or process, respectively, known to all detectors based on physical measurement processes. Also, interposed signal processing components may modify or contribute to the background noise.

The enumeration of the background sources described above may not be complete. Further background generating processes may be involved and contribute to the complete background noise or background signal, respectively, known to those skilled in the art.

The continuous level adjustment may also compensate sensitivity differences of infrasonic detectors and components processing the obtained infrasonic signals by the infrasonic detector and interposed between infrasonic detector and evaluation process of the infrasonic signals. These components, without limitation, may be signal amplifiers, signal filters and the like. Properties of detectors and signal processing components may vary within the series. This may lead to an overall different signal sensitivity due to the variation arid/or to different background noise contributions. The continuous level adjustment according to an embodiment of the present invention may be able to compensate such effects and allow evaluation of infrasonic signals in a comparable way by different implementations of the signal evaluation process in the case of using components with varying properties.

FIG. 1*b* shows a flow diagram of the continuous level adjustment algorithm according to FIG. 1*a*. Further, additional references to FIG. 1*a* will be provided to enlighten broadly the method for evaluating an infrasonic signal with respect to an embodiment of the invention.

In an operation S1.6 an averaged infrasonic signal $V_{av}$ is provided. According to the FIG. 1*a,* this signal is provided by operation S1.2.

The operations S1.7, S1.8 and S.19 represent in detail the continuous level adjustment referred as operation S1.3 in FIG. 1*a*.

In an operation S1.7, an infrasonic noise signal $V_{Noise}$ is determined from an averaged infrasonic noise signal $V_{av}$ noise representing the level of the infrasonic background noise and the averaged infrasonic signal $V_{av}$. A non-linear weighting function (NLF) may be employed to weight the averaged infrasonic signal in comparison to the averaged infrasonic noise signal $V_{av\ noise}$. The result of the non-linear weighting function (NLF) is used for rating the averaged infrasonic noise signal $V_{av\ noise}$. If the averaged infrasonic signal $V_{av}$ is equal to the averaged infrasonic noise signal $V_{av\ noise}$, the values of the averaged infrasonic noise signal $V_{av\ noise}$ may be assigned unmodified to the infrasonic noise signal $V_{Noise}$. In the case of an averaged infrasonic signal $V_{av}$ greater than the averaged infrasonic noise signal $V_{av\ noise}$, a value which is greater than the value of the averaged infrasonic noise signal $V_{av\ noise}$, may be assigned to the infrasonic noise signal $V_{Noise}$. Further, in the case of an averaged infrasonic signal $V_{av}$ smaller than the averaged infrasonic noise signal $V_{av\ noise}$, a value which is smaller than the value of the averaged infrasonic noise signal $V_{av\ noise}$ may be assigned to the infrasonic noise signal $V_{Noise}$.

The result of the operation S1.7 may be denoted mathematically by following term:

$$V_{noise} = V_{AV\ Noise} \cdot NLF\left(\frac{V_{AV}}{V_{AV\ Noise}}\right)$$

wherein the function NLF may be defined as follows:

$$NLF(x) = \begin{cases} y > x & \text{for } 1 \le x < 1 \\ 1 & \text{for } x = 1 \\ y < x & \text{for } 1 < x \end{cases}$$

This definition of the non-linear function NLF may fulfill the weighting of the averaged infrasonic noise signal in an adequate way.

In an operation S1.8, the infrasonic noise signal $V_{av}$ is averaged by a suitable and adapted averaging method to provide the averaged infrasonic noise signal $V_{av\ noise}$ The averaging method may be a timely averaging to reduce variations in the infrasonic noise signal $V_{av}$ since it is assumed that processes changing the signal strength of the background noise are occurring on a time scale which is longer than the time scale of processes generating infrasonic signals which are desired to be extracted in order to initiate the trigger as a result of the comparison operation in operation S1.5 in FIG. 1*a*. The operation may provide the averaged infrasonic noise signal $V_{av\ noise}$.

It may be noted that the continuous level adjustment according to an embodiment of the present invention is an iterative method for obtaining an averaged infrasonic noise signal $V_{av\ noise}$. In the beginning, the averaged infrasonic noise signal is unknown in the operation S1.7 since this signal may be provided by operation S1.8 for the first time. A suitable adapted initial signal value may be assigned to the unknown averaged infrasonic noise signal $V_{av\ noise}$. For example, the averaged infrasonic signal value ($V_{av}$) may be assigned to the averaged infrasonic noise signal $V_{av\ noise}$ and a suitable adapted defined non-linear function NLF may ensure that the continuous level adjustment converges to an averaged infrasonic noise signal $V_{av\ noise}$ representing the averaged value of the background noise signals.

In an operation S1.9, the averaged infrasonic noise signal $V_{av\ noise}$ may be offset with an offset value to provide the infrasonic level signal $V_{limit}$.

The offset value may be an absolute offset value increasing the averaged infrasonic noise signal $V_{av\ noise}$ by a constant offset value. Furthermore, the offset value may be a relative offset value increasing the averaged infrasonic noise signal $V_{av\ noise}$ by a relative offset value according to the value of the averaged infrasonic noise signal $V_{av\ noise}$.

According to an embodiment of the invention, a signal to ratio value (SNR) 20 may provided as offset value. SNR values are known to those skilled in the art for defining signal values and levels with respect to background noise of the respective signal. The infrasonic level signal $V_{limit}$ may be based on the SNR value 20 and on the averaged infrasonic noise signal $V_{av\ noise}$ according to the following mathematical term:

$$V_{Limit} - V_{AV\ Noise} \cdot \text{SNR}$$

An additional pre-defined offset value of the continuous level adjustment allows adapting the continuous level adjustment to different operating conditions associated with different background noise processes. The fluctuations of the background signals may be of different magnitude and an adjustable offset value may allow adapting the fluctuations in the background noise.

In an operation S1.10, the provided infrasonic level signal may be provided to further operations and processing functions. According to an embodiment of the invention and with respect to FIG. 1*a, the infrasonic level signal* $V_{limit}$ is provided to operation S1.4 to be compared with the averaged infrasonic signal for evaluating $V_{av}$ and generating of a trigger signal depending on the comparison result of operation S1.4 in FIG. 1*a*.

The presented mathematical terms may not be limiting. These terms are provided to enlighten the scope and the virtue of the continuous level adjustment. According to the basic concept of the continuous level adjustment further embodiments may be suitable.

Figure 2:
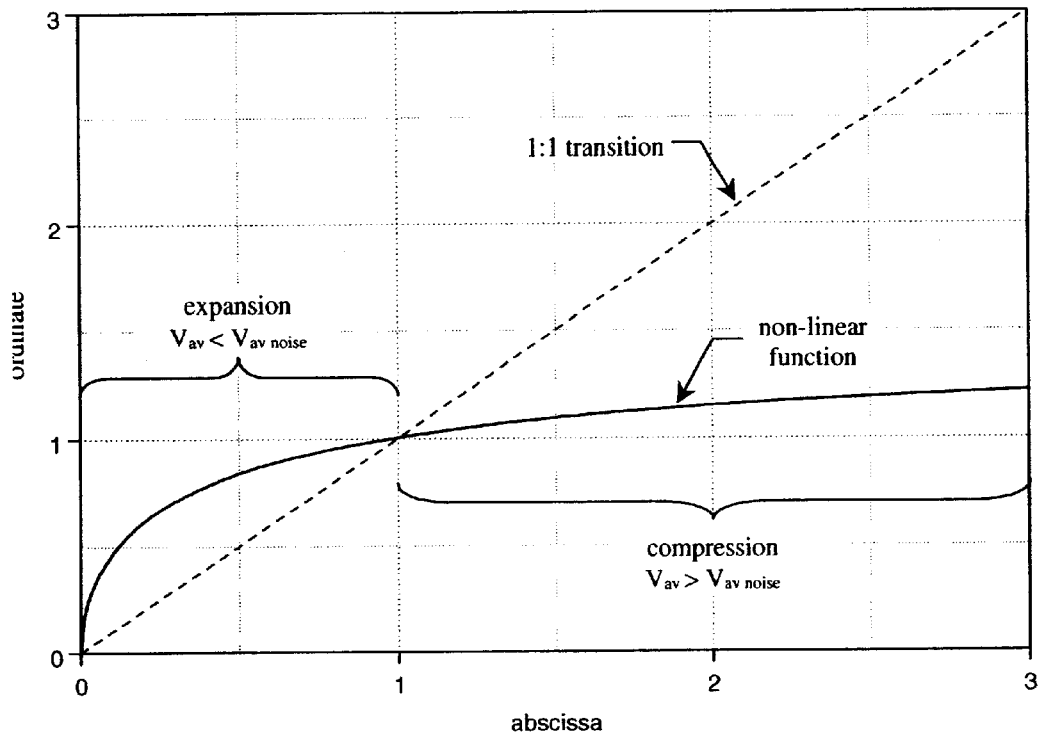
FIG. 2 shows a plot illustrating a non-linear function according to the continuous level adjustment algorithm with respect to an embodiment of the invention.

A non-linear function NLF according to the above described definition of the non-linear function is given in the description of FIG. 2. This plotted non-linear function NLF is an exemplary nonlinear function out of a plurality of possible non-linear functions which fulfill the given definition.

FIG. 2 shows a function plot illustrating a non-linear function according to the continuous level adjustment algorithm with respect to an embodiment of the invention.

The plot depicts a function x=y, denoted as 1:1 transition, and a non-linear function suitable for operating in the continuous level adjustment like described above. The argument of the functions is plotted on the horizontal axis or abscissa, respectively, whereas the result of the functions is plotted on the vertical axis or ordinate, respectively. Both axis show a value range of 1 to 3.

Referring back to operation S1.7 shown in FIG. 1*b,* the argument of the non-linear function is a quotient of the averaged infrasonic signal $V_{av}$ and the averaged infrasonic noise signal $V_{av\ noise}$, i.e. the ratio of the current evaluated signal and the averaged signal noise. An argument between 0 and 1 means that the current signal is smaller as the obtained averaged noise of the infrasonic signal, whereas an argument greater than 1 means accordingly that the current infrasonic signal is higher than the obtained averaged noise of the infrasonic signal. The first-mentioned argument range may be denoted as an expansion range and the last-mentioned argument range may be denoted as compression range.

The function x=y or 1:1 transition assigns the arguments unmodified to the function values, respectively. Hence, the value of functions depicted above this 1:1 transition are greater than the value of its respective arguments. Accordingly, the value of functions depicted above this 1:1 transition are smaller than the value of its respective arguments. Consequently, the naming "expansion range" and "compression range" may be understood since the non-linear function is depicted above and below the 1:1 transition, respectively.

Employing the method according to an embodiment of the invention means that an averaged infrasonic signal $V_{av}$, which is smaller than the averaged infrasonic noise signal $V_{av\ noise}$, is amplified whereas an averaged infrasonic signal $V_{av}$, which is greater that the averaged infrasonic noise signal $V_{av\ noise}$, is reduced. First and foremost, a small slope of the non-linear function within the compression range reduces considerably high infrasonic signals so that these infrasonic signals do not affect significantly the determination of the averaged infrasonic noise signal. The non-linear function may be used as a weighting non-linear function of the current infrasonic signal with respect to the averaged infrasonic noise signal.

Summarizing the most important points:

low volume signals are enhanced, high volume signals, especially high peak signals are strongly suppressed, even an extremely high peak of the infrasonic signal does not have any impact to cause the generated averaged noise signal to increase significantly, using the non-linear weighting function allows the use of a relatively short time for determining the average of the noise signal, and the continuous level adjustment is able to adapt relatively quick to a changing noise background without being affected by high signal peaks.

The definition of the non-linear function is free. A concrete function term has to fulfill the conditions of the expansion range and the compression range. Further conditions are not assigned to the non-linear function. The specific slope of the non-linear function may be adapted to a special embodiment of the invention with respect to the conditions under which infrasonic signals are obtained for a following evaluation.

In the following, an exemplary measurement employing the above described method for evaluating an infrasonic signal is illustrated. Therefore, an embodiment according to the method for evaluating an infrasonic signal may be implemented to monitor a sleeping room and to realize a monitoring alarm system. The monitoring is carried out in a user's sleeping room from approximately 12 p.m. at the evening to 10 a.m. at the next morning. Different signals according to the embodiment of the invention are described.

Figure 3:
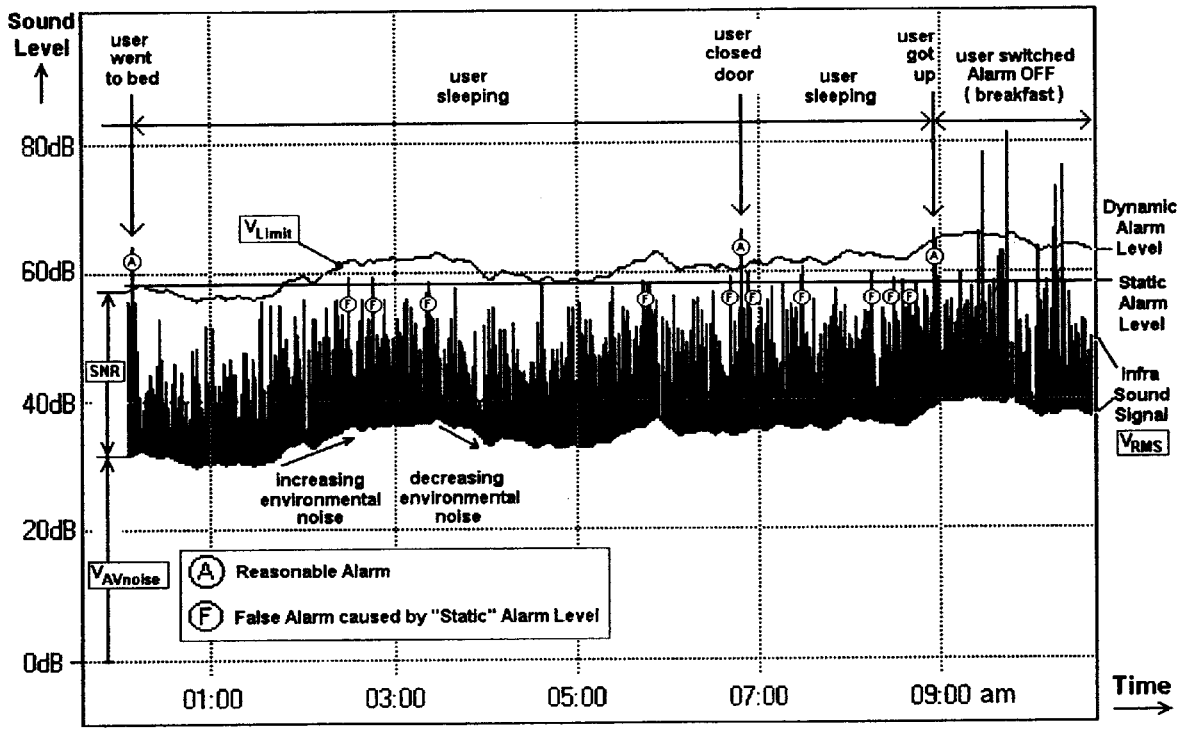
FIG. 3 shows a time plot of an infra-sound measurement illustrating the evaluation according to the continuous adjustment algorithm with respect to an embodiment of the invention.

FIG. 3 shows a time plot of an infra-sound measurement illustrating the evaluation according to the continuous adjustment algorithm with respect to an embodiment of the invention.

The exemplary measurement of infrasonic signals and the corresponding averaged infrasonic noise signal $V_{av\ noise}$ infrasonic level signal $V_{limit}$ during the monitoring process are depicted in FIG. 3. The abscissa shows the time at which the signals are measured and obtained, respectively. The ordinate shows the value of the signals depicted as decibel units. Signal values below the averaged infrasonic noise signal $V_{av\ noise}$ are not plotted with only signal values above this value being plotted in FIG. 3.

The slope of the averaged infrasonic noise signal $V_{av\ noise}$ represents the noise background which is denoted as environmental noise herein. It may be seen that the continuous level adjustment provides a suitable method for the determination of the noise background of an infrasonic signal measurement. This noise background varies over the measurement time and the averaged infrasonic noise signal $V_{av\ noise}$ follows accordingly these variations.

The infrasonic level signal $V_{limit}$ may be obtained by offsetting the averaged infrasonic noise signal $V_{av\ noise}$ with an offset value. Herein a signal-to-noise ration SNR is employed for offsetting the averaged infrasonic noise signal $V_{av\ noise}$.

The single tips of the plotted infrasonic peaks represent the averaged infrasonic signals $V_{av}$. Herein a root mean square averaging is performed to provide the averaged infrasonic signals $V_{av}$ which in the following is denoted as root mean square infrasonic signals $V_{RMS}$. Root mean square infrasonic signals $V_{RMS}$ within the band are limited by the averaged infrasonic noise signal. The infrasonic level signal may not initiate a trigger signal since these signals are smaller than the infrasonic level signal.

The alarm system is switched on with the beginning of the signal recording of the plot in FIG. 3. Signals indicated with an indicator A may reference infrasonic signal above the infrasonic level signal. Accordingly, these signals may have initiated a generation of a trigger signal. The alarm system may indicate a significant monitoring signal on such a trigger signal and may rise an alarm. Three events are indicated. The first significant signal indicated with the indicator A coincidences the event that the user went to bed. This procedure has generated an infrasonic signal, due to moving a door, which was detected by the alarm system. The second event shows an infrasonic signal which was generated by closing a door. The third event shows an event when the user got up. Other significant infrasonic signals had not passed the infrasonic level signal and were therefore not evaluated as significant signals.

In order to compare an embodiment according to the invention with an infrasonic monitoring system of state of the art, a second static alarm level is provided arid an infrasonic signal evaluation is carried out according to this static alarm level. Static alarm level means that a constant infrasonic level signal is used for evaluating the measured infrasonic signals wherein the static alarm level is not adapted to the changing background. The static alarm level may be seen as a horizontal line in the plot of the measured infrasonic signal. Single signals which may have initiated an alarm due to passing the static alarm level are indicated by indicator F. These events are false alarm events due to the dynamic alarm level which corresponds to the infrasonic level signal obtained by the continuous level adjustment.

Accordingly, the employment of a background adjusted infrasonic level signal for evaluating infrasonic signals is advantageous since a false alarm event may be prevented. Alarm systems have to be reliable. The more false alarm events are generated by the alarm system, the more alarm events are ignored even if the alarm event are reasonable. A rising background noise may initiate a lot of false alarm events in the case of a static alarm level.

An embodiment according to the invention determines the average infrasonic noise signal $V_{av\ noise}$ and multiplies that signal with a sufficient application specific signal-to-noise ratio SNR. For example a ratio of 6 dB may be a sufficiently better specific noise to signal ratio for monitoring a single room of a building/house whereas a ratio of 18 dB may be a sufficiently better specific noise to signal ratio for monitoring a spacious interior of a motor vehicle.

Another advantage of an embodiment according to the method of the invention may be that a background adapted alarm level may be effectively smaller than a static alarm level, since a static alarm level may be set to a static level which ensures that the number of false alarms is as small as possible. Therefore, the users of alarm system employing static alarm levels often take more likely a risk of a higher alarm level and thereupon of undetected events. The continuous level adjustment allows overcoming this problem.

An embodiment according to the invention may comprise an infrasonic detector to obtain infrasonic signals and an implementation of the method for evaluating infrasonic signals thereof. Infrasonic detectors may be adapted to an infrasonic frequency range or a part of an infrasonic frequency range according to the application of the embodiment. The infrasonic frequency range may cover a frequency range of approximately 0.2 Hz to 20 Hz. This frequency range may not be covered completely by the infrasonic detectors. For example a frequency range of 2 Hz to 20 Hz may be suitable for monitoring systems like alarm systems.

Moreover, microphones may be suitable detector devices for detecting infrasonic signals. Even voice or audio microphones may be used as infrasonic detectors. The sensitivity of such adapted microphones may have to be increased by suitable amplification of the obtained signals. An implementation of an infrasonic detection system in combination with an evaluation unit according to an embodiment of the present invention is described in the following figures.

Figure 4:
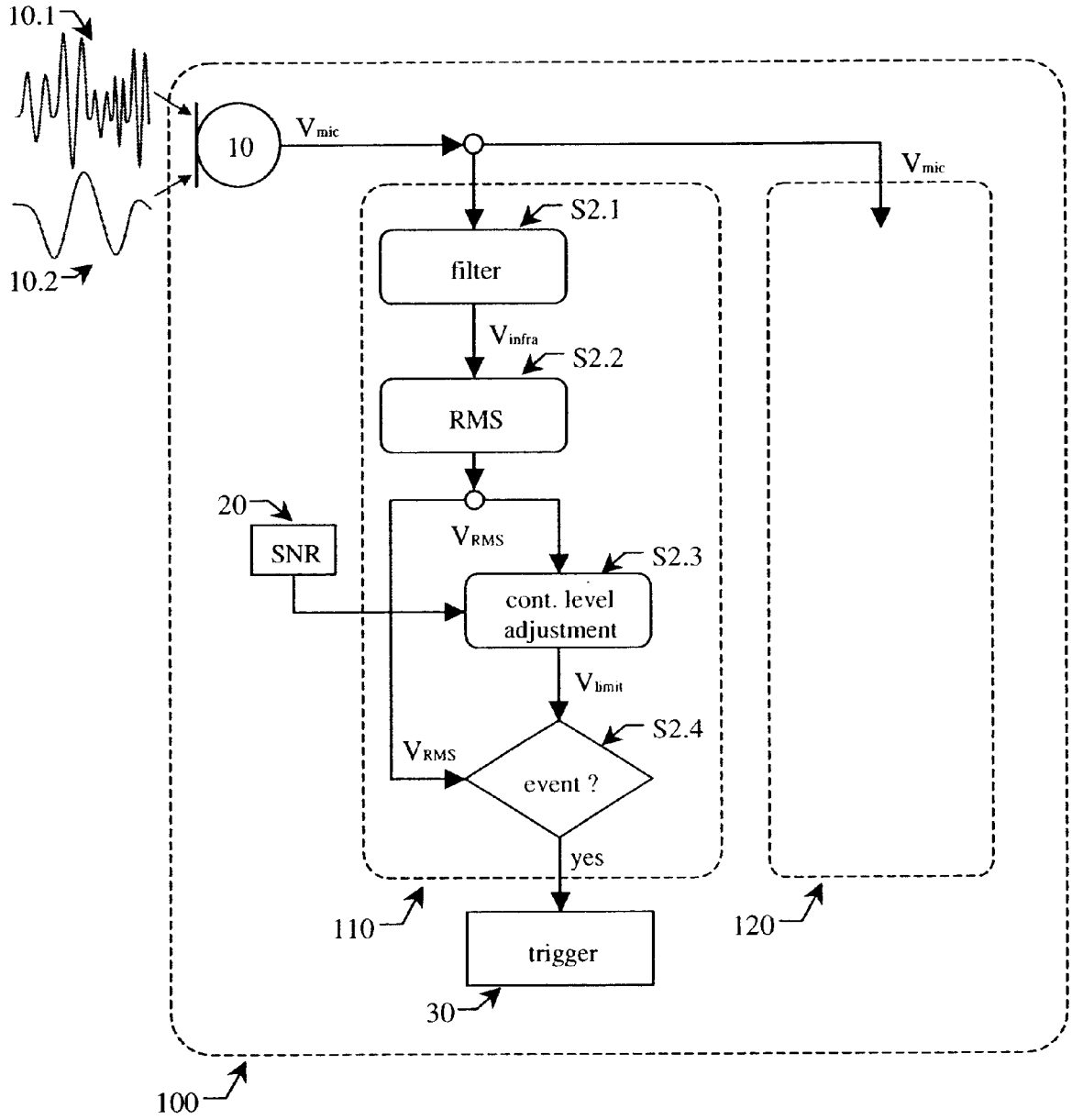
FIG. 4 shows a schematic diagram of audio signal processing device equipped with a microphone and extended to evaluate an infrasonic signal according to an embodiment of the invention.

FIG. 4 shows a schematic diagram of an audio signal processing device equipped with a microphone and extended to evaluate an infrasonic signal according to an embodiment of the invention. A signal processing device 100 may be provided. The device 100 may comprise a microphone 10 adapted to detect infrasonic signals 10.2 and an audio signal 10.1, such as especially voice signals. The obtained signal $V_{mic}$ may be passed to an evaluation unit 110 for evaluating the infrasonic signals. The infrasonic signal may have to be extracted from the audio signal $V_{mic}$ due to the wide frequency range of the microphone 10.

In an operation S2.1, the audio signals $V_{mic}$ may be filtered using a filter adapted to an infrasonic frequency range of part of this frequency range. According to the frequency range and the properties of the microphone 10, a low-pass or a band-pass filter may be used for extraction of the infrasonic signals. Both the low-pass filter characteristic arid the band-pass filter characteristic may have to be limited to the desired infrasonic frequency range. The filtering of the audio signals $V_{mic}$ may yield to the infrasonic signals $V_{infra}$.

In an operation S2.2, the yielded infrasonic signals $V_{infra}$ may be averaged. A suitable and preferable averaging of the infrasonic signals $V_{infra}$ may be a root mean square averaging which yields to root means square infrasonic signals $V_{RMS}$.

In an operation S2.3, an infrasonic level signal $V_{limit}$ is determined from the root mean square infrasonic signal $V_{RMS}$ by employing the continuous level adjustment as described above in detail. An additional offset value, herein a signal-to-noise ratio (SNR) 20, may be provided to the continuous level adjustment of operation S2.3 to adapt the infrasonic level signal $V_{limit}$ to the working conditions of the signal processing device 100, such as especially the sensitivity of the infrasonic signal evaluation.

In an operation S2.4, the root mean square infrasonic signals $V_{RMS}$ may be compared with the infrasonic level signal $V_{limit}$ determined from the root mean square infrasonic signals $V_{RMS}$ and the offset SNR 20. If the root mean square infrasonic signals $V_{RMS}$ is greater than the infrasonic level signal $V_{limit}$, a trigger signal 30 is generated. The trigger signal 30 may indicate that an infrasonic signal has passed a threshold value defined by the infrasonic level signal $V_{limit}$. Further, the trigger signal 30 may be employed for triggering further provided internal or external components which are responsive on this trigger signal 30. For example, the trigger signal may be used to initiate an alarm of an alarm system.

An embodiment comprising microphone 10, evaluation unit 110 and trigger 30 allows setting up an independent device for evaluating infrasonic signals. The provided trigger signal may be connected to further devices, such as alarm system, which may response suitably to the trigger signal. The embodiment of the invention according to FIG. 4 may be realized as an electronic circuit. Preferably, a digital signal processing (DSP) unit may comprise a software tool or an executable code section for carrying out the operations. The utilization of a DSP unit may need an analog-to-digital converter (ADC) for receiving the analog signals of a microphone and providing a corresponding digital signal.

It may also be possible that the device 100 may comprise additional units since the microphone 10 may be adapted to audio frequencies and infrasonic frequencies. The detected and obtained audio frequencies may be processed in an additional unit 120. It may be noted that the unit 120 may constitute an arbitrary number of units for processing signals obtained by the microphone. A plurality of devices may be appropriate to comprise a plurality of units processing audio and infrasonic signals which are obtained by a single adapted microphone. Preferably, the audio processing device may be a voice or speech processing device, respectively. Further, it may be possible that the built-in microphone is not adapted to obtain infrasonic signals. Since microphones adapted to audio frequencies and infrasonic frequencies with an appropriate sensitivity are available and the exchange of the built-in microphone may be carried out easily.

Mobile phones and especially built-in phones in motor vehicles may provide the possibility to include a unit for evaluating infrasonic signals for monitoring spaces, such as especially a spacious interior of a motor vehicle to serve as alarm system. Usually, mobile phones comprise a digital signal processing (DSP) unit for processing voice or speech audio signals, respectively. This DSP unit may comprise an additional software tool or a code section according to an embodiment of the invention for evaluating the infrasonic signals. Moreover, in the case of employing a mobile or built-in phone for monitoring, the phone may generate a message which may be transmitted to the respective owner, to a security service provider, to the police or the like in response to a trigger signal generated by the infrasonic evaluation. The message may be a short message service (SMS) message according to the GSM standard for mobile communication. According messages services are provided by other mobile communication systems like UMTS, WCDMA, DCS etc.

Further, the phone may automatically call a pre-defined number to transmit a voice message or to enable the receiver of the call to listen to the occurrences which initiated the trigger signal of the infrasonic evaluation, such as, for example enable the receiver to decide if the infrasonic evaluation initiated a false or a reliable alarm.

It may be noted that mobile or built-in phones of motor vehicles are only an example for the implementation of the infrasonic evaluation. In the future, devices especially devices integrated in motor vehicles, may be controlled by voice or speech commands, such as voice controlled phones, radio receivers, navigation systems, air conditioning systems and likely user controlled equipment. This method of controlling electrical devices provides a secure and simple controlling method. All these voice and speech controlled devices require an audio signal detector, for example a microphone, and an audio signal processing unit. These voice and speech controlled devices may provide the possibility of implementing an infrasonic evaluating unit according to an embodiment of the invention.

Nevertheless, also further processing devices may implement the method for evaluating infrasonic signals. For example standard computers or mobile terminal devices comprising or connected to a microphone for detecting infrasonic signals may be used for evaluating according to an embodiment of the invention.

The following figures present embodiments of the present invention included in a phone for mobile communication. The phone may be a mobile phone or a built-in mobile phone in a motor vehicle. According to the description above embodiments may be also included in further voice controlled and voice processing devices but which should not be considered limiting.

Figure 5:
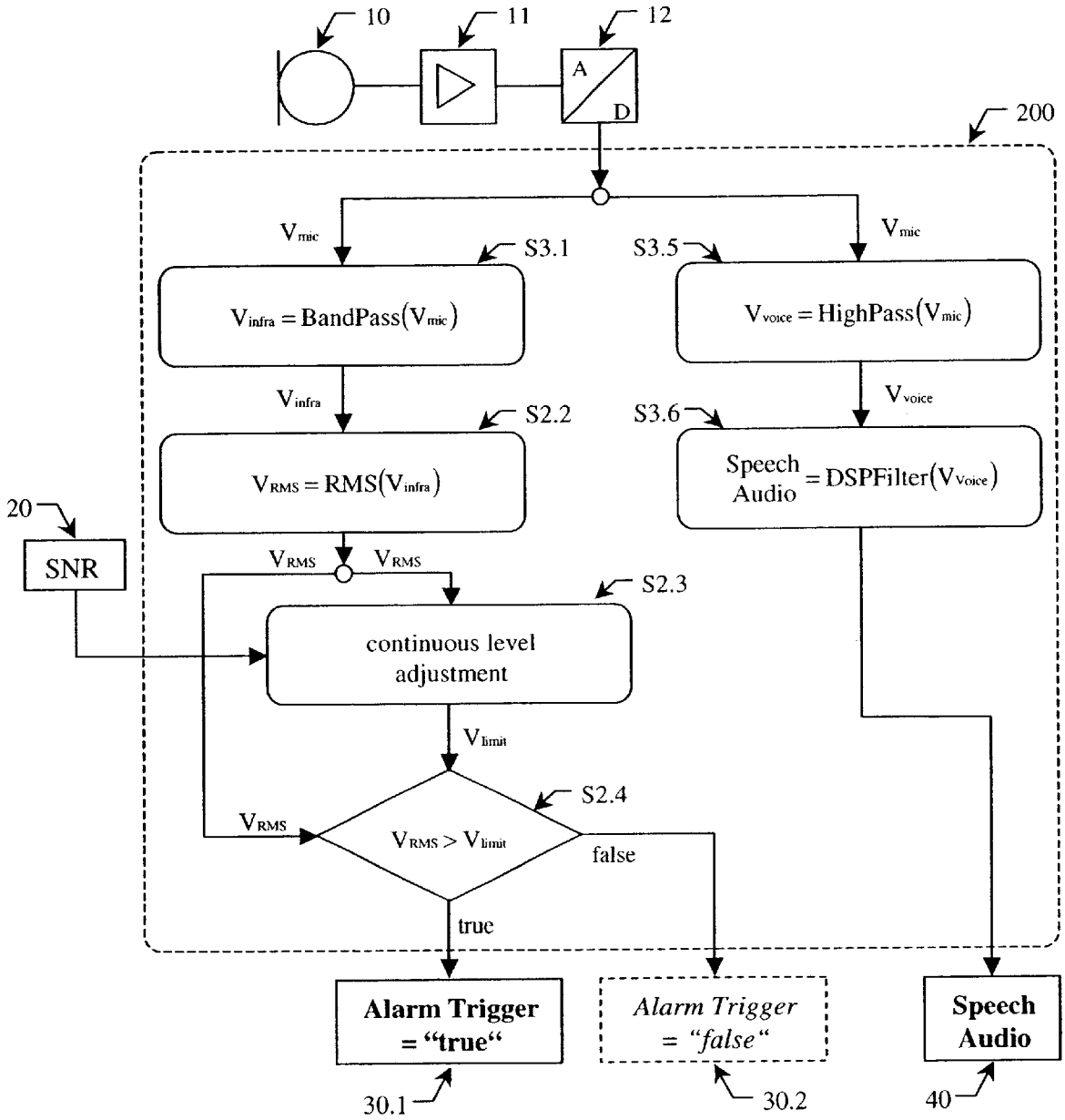
FIG. 5 shows an implementation of the infra-sound detection device within a digital signal processor of a mobile phone with respect to an embodiment of the invention.

FIG. 5 shows an implementation of the infra-sound detection device within a digital signal processor of a mobile phone with respect to an embodiment of the invention. A microphone 10 adapted to voice audio and infrasonic audio may detect the signals. A pre-amplifier 11 may amplify the signals and an analog-to-digital converter (ADC) 12 may convert the microphone detected signals to digital signals which may be processed by a digital signal processing unit 200. According to the embodiment of the invention, the microphone signal may be passed to voice audio processing and to infrasonic audio processing. The digital signal processing unit 200 may provide different signals thereof, such as an alarm trigger 30.1 generated by the infrasonic evaluating process and a speech audio signal 40. The alarm trigger 30.1 may be used to trigger further units responsive in an appropriate way thereto. The speech audio signal 40 may be passed to the further units operating speech audio signal 40 in a mobile phone, like the transmitting unit.

In an operation S3.1, the infrasonic signal $V_{infra}$ may be extracted from the microphone signal $V_{mic}$ by employing a band-pass filter limited to the desired infrasonic frequency range.

In an operation S2.2, a root mean square averaging of the infrasonic signal $V_{infra}$ yields a root mean square signal $V_{RMS}$.

In an operation S2.3, the continuous level adjustment yields the infrasonic level signal $V_{limit}$. A signal-to-noise ratio SNR 20 may be provided to the continuous level adjustment to adapt the sensitivity of the infrasonic evaluation.

In an operation S2.4, the root mean square infrasonic signal and the infrasonic level signal may be compared to yield a trigger signal. The trigger signal may be a signal providing two trigger levels. A first trigger level may indicate that the root mean square $V_{RMS}$ is greater than the determined infrasonic level signal $V_{limit}$ and a second trigger level may indicate the corresponding other case of the signal comparison. A trigger signal able, comprising two signal levels, is indicated in FIG. 5 by a trigger signal denoted as alarm trigger as "true" 30.1 or by a trigger signal denoted as alarm trigger "false" 30.2.

The voice audio signals may be operated simultaneously in operations S3.5 and S3.6.

In an operation S3.5, the microphone signal $V_{mic}$ may be filtered using a high-pass filter. The high-pass filter may be limited to a desired part of the voice frequency. The filtering may yield a voice signal $V_{voice}$.

In an operation S3.6, the voice signal may be further filtered and processed according to the needs of the signal processing for mobile communication systems. These processing methods and operations are outside the scope of the present invention.

The above described implementation of the operating steps using a digital signal processor should be considered as not limiting. It may also be possible that the operations are carried out by a different processing device. Further an electronic circuit may also enable the processing of the operations in a comparable and appropriate way.

According to an embodiment of the invention, only a few modifications have to be carried out to implement the infrasonic evaluation process within a mobile phone of state of the art. Correspondingly, a motor vehicle built-in phone may be designed, which is comparable to a mobile phone and therefore the description also relates to this phone type.

Figure 6:
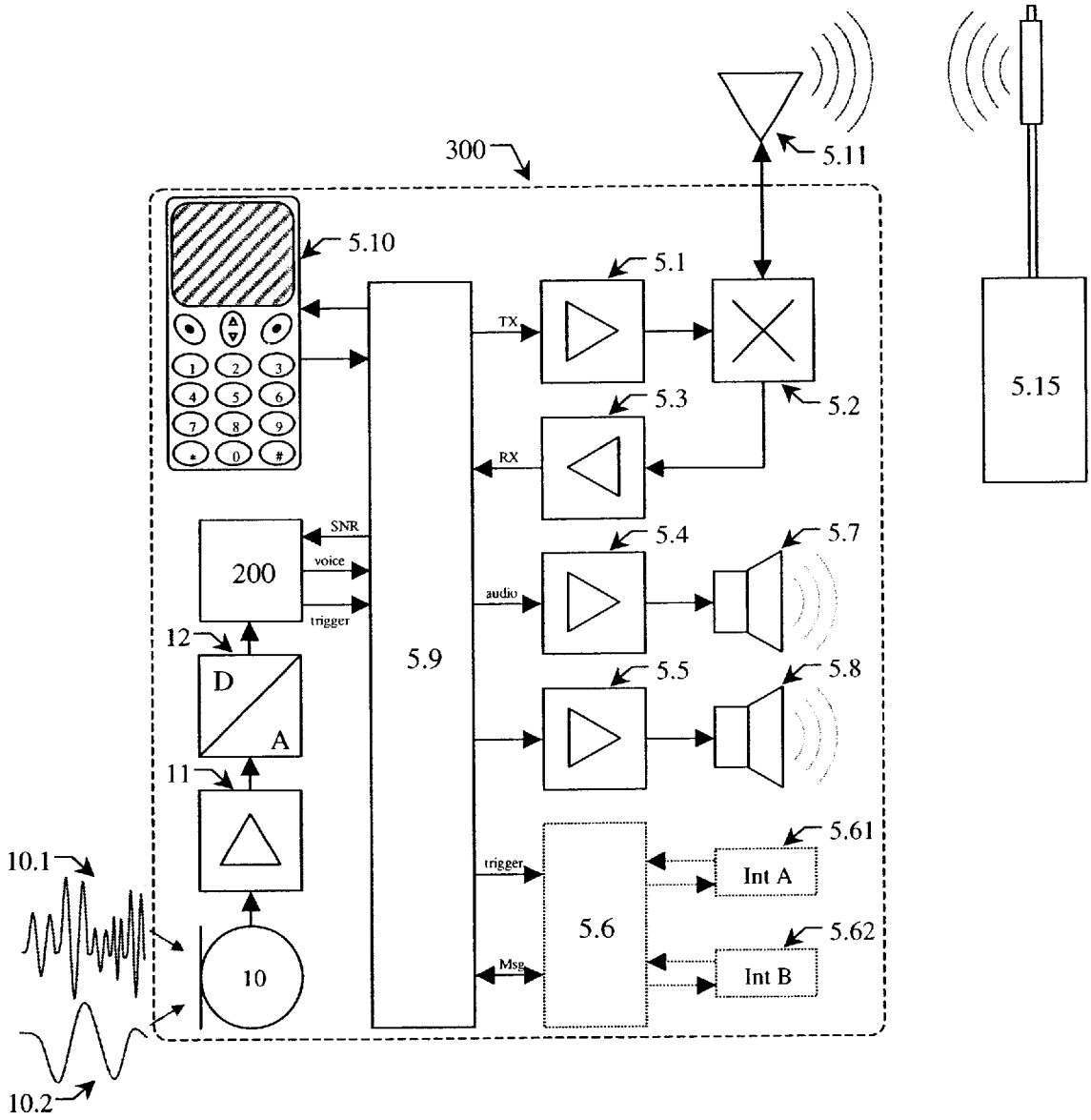
FIG. 6 shows a mobile phone with implemented infra-sound detection according to an embodiment of the invention.

FIG. 6 shows a mobile phone with an implemented infra-sound detection according to an embodiment of the invention. The mobile phone 300 may comprise a microphone 10, a preamplifier 11, an analog-to-digital converter (ADC) 11 and a digital signal processing unit (DSP) 12. Further, a user input/output unit 5.10, comprising a keyboard and a display, may be connected to a core electronic 5.9 for providing input commands of the user to the core electronic 5.9 and outputting signals and messages to inform the user. Further, the core electronic 5.9 may provide a transmission signal (TX), due to the functions of the mobile phone, which may be amplified by amplifier 5.1 and passed to the antenna 5.11 though a signal coupler 5.1. Signals (RX) received by the antenna 5.11 may be passed through the signal coupler 5.2 and amplified by amplifier 5.3 to the core electronic 5.9. Audio signals, like voice signals generated from the received signals, may be passed from the core electronic 5.9 through an amplifier 5.4 to an ear speaker 5.7. Additionally, a buzzer 5.8 may be connected to the core electronic 5.9 through a driver 5.5 to generate indicating audio signals. The DSP unit 200 may provide voice signals and a trigger signal to the core electronic 5.9. The core electronic 5.9 may also provide a signal-to-noise ratio SNR value to the DSP 200 unit.

Additionally, an optional. interface 5.6 may be implemented in the mobile phone 300. The interface 5.6 may receive the trigger from the core electronic 5.9 and may exchange further messages (msg) with the core electronic 5.9. The interface may also provide interface connectors 5.61 and 5.62. The interface connector 5.61 may be a relay input/output connector and the interface connector 5.62 may be a controlling bus connector, such as for example, a plug on a CAN bus system. The connectors may enable control or transmission of a control command to an external or central alarm system.

The microphone may be adapted to detect infrasonic signals and voice audio signals. The DSP unit 200 may provide the signal processing for the voice signals and also the signal evaluation of the infrasonic signals. Such an implementation according to an embodiment of the invention of a DSP unit is described above with respect to FIG. 5. The SNR value may be provided by the core electronic enabling the user of the mobile phone to adapt this SNR value to the operating conditions of the infrasonic signal evaluation.

According to the trigger provided to the core electronics, a plurality of functions and operations may be initiated. A mobile or built-in phone for monitoring the phone may generate a voice or text message which may be transmitted to the respective owner, such as to a security service provider, to the police or the like in response to a trigger signal generated by the infrasonic evaluation. The message may be a short message service (SMS) message according to the GSM standard for mobile communication. Accordingly, messages services are provided by other mobile communication systems like UMTS, WCDMA, DCS etc. Further, the phone may automatically call a pre-defined number to transmit a voice message or to enable the receiver of the call to listen to the occurrences which initiated the trigger signal of the infrasonic evaluation, such as for example, to let the receiver decide if the infrasonic evaluation initiated a false or a reliable alarm.

Since an approximate position of radio frequency phone operation according to a mobile communication system may be determined by the provider of the mobile communication services or another authorized provider of this service, the determination of the current position of the mobile phone may be initiated. The initiation of the determination of the position may be initiated by transmitting a special message of the mobile phone due to the trigger signal to a provider 5.15.

It may be noted, that the implementation of an embodiment according to this invention within an audio or voice processing device may be carried out by a few modifications and additions.

It is to be understood that the above described embodiment of the invention is illustrative only, and that modifications thereof may occur to those skilled in the art. Accordingly, this invention is not to be regarded to be the embodiment disclosed herein, but is to be limited only as defined by the appended claims.

What is claimed is:

1. A method for monitoring a surveyed space by evaluating an infrasonic signal obtained from said surveyed space, comprising:

averaging said infrasonic signal from said surveyed space to provide an averaged infrasonic signal, mapping said averaged infrasonic signal according to a function to provide an infrasonic noise signal, averaging said infrasonic noise signal to provide an averaged infrasonic noise signal, offsetting said averaged infrasonic noise signal with an offset value to provide an infrasonic level signal, comparing said infrasonic level signal with said averaged infrasonic signal and generating a trigger signal if said averaged infrasonic signal is greater than said infrasonic level signal.

2. A method according to claim 1, wherein a signal is filtered through a filter to provide said infrasonic signal and wherein a filter characteristic is limited to an infrasonic frequency range.

3. A method according to claim 1, wherein said averaging of infrasonic signal to provide an averaged infrasonic signal is a root mean square averaging.

4. A method according to claim 1, wherein said function is additionally rated with said averaged infrasonic noise signal to provide said infrasonic noise signal.

5. A method according to claim 1, wherein said function is a non-linear function.

6. A method according to claim 1, wherein said function maps a result of a combination of said averaged infrasonic signal and said averaged infrasonic noise signal to provide said infrasonic noise signal.

7. A method according to claim 1, wherein said function maps a result of a division of said averaged infrasonic signal and said averaged infrasonic noise signal to provide said infrasonic noise signal.

8. A method according to claim 1, wherein said function maps a result of a division of said averaged infrasonic signal and said averaged infrasonic noise signal and a result of said function is multiplied with said averaged infrasonic noise signal to provide said infrasonic noise signal.

9. A method according to claim 1, wherein said offset value is an absolute offset value.

10. A method according to claim 1, wherein said offset value is a relative offset value, wherein said relative offset value is relative to said averaged infrasonic noise signal.

11. A method according to claim 1, wherein said offset value is a multiplied averaged infrasonic noise signal for rating said averaged infrasonic noise signal to provide said infrasonic level signal.

12. A method according to claim 1, wherein said offset value is adjustable.

13. A software tool for monitoring a surveyed space by evaluating an infrasonic signal obtained from said surveyed space, comprising program code portions for carrying out the operations of claim 1 when said program is implemented in a computer program.

14. A method for monitoring in accordance with claim 1, including a computer program for monitoring a surveyed space by evaluating an infrasonic signal obtained from said surveyed space, comprising program code portions for carrying out operations when said program is executed on a computer, a processing device or a digital signal processor.

15. A method for monitoring in accordance with claim 1, including a computer program product for monitoring a surveyed space by evaluating an infrasonic signal obtained from said surveyed space, comprising program code portions stored on a computer readable medium for carrying out operations when said program product is executed on a computer, a processing device or a digital signal processor.

16. A module for monitoring a surveyed space by evaluating an infrasonic signal obtained from said surveyed space, comprising:

a first averaging component for averaging said infrasonic signal from said surveyed space to provide an averaged infrasonic signal, a mapping component for mapping said averaged infrasonic signal according to a function to provide an infrasonic noise signal, a second averaging component for averaging said infrasonic noise signal to provide an averaged infrasonic noise signal, an offsetting component for offsetting said averaged infrasonic noise signal with an offset value to provide an infrasonic level signal, a comparing component for comparing said infrasonic level signal with said averaged infrasonic signal and a generating component for generating a trigger signal if said averaged infrasonic signal is greater than said infrasonic level signal.

17. A module according to claim 16, comprising a filter component for filtering a signal to provide said infrasonic signal and wherein said filter characteristic is limited to an infrasonic frequency range.

18. A module according to claim 16, wherein said first averaging component is a root mean square averaging component.

19. A module according to claim 16, wherein said mapping component comprises additionally a rating component for rating said function with said averaged infrasonic noise signal to provide said infrasonic noise signal.

20. A method for monitoring in accordance with claim 1, including a device for monitoring a surveyed space by evaluating an infrasonic signal obtained from said surveyed space, comprising:

a detector to detect sound waves from said surveyed space adapted to a frequency range including an infrasonic frequency range, components responsive to a trigger signal and a processing unit, wherein said processing unit carries out the operations of a method of a surveillance system for monitoring by evaluating said infrasonic signal and wherein said trigger signal is generated according to said method.

21. A method according to claim 20, wherein said detector is a microphone.

22. A method according to claim 21, wherein said microphone is adapted to detect infrasonic signals and voice/speech audio signals.

23. A method according to claim 20, wherein said device is a radio frequency phone operating according to a mobile communication system.

24. A method according to claim 20, wherein said device is a voice/speech controlled device.

25. A module in accordance with claim 16 including a surveillance system for monitoring a surveyed space by evaluating an infrasonic signal obtained from said surveyed space, comprising: a a device processing voice/speech audio and infrasonic signals obtained from the surveyed space comprising:

a detector to detect sound waves from the surveyed space adapted to a frequency range including an infrasonic frequency range and components responsive to a trigger signal, wherein said trigger signal is generated by said module.

26. A module according to claim 25, wherein said detector is a microphone.

27. A module according to claim 25, wherein said microphone is adapted to detect infrasonic signals and voice/speech audio signals.

28. A module according to claim 25, wherein said device is a radio frequency phone operating according to a mobile communication system.

29. A module according to claim 25, wherein said device is a voice/speech controlled device.

* * * * *